US006026516A

United States Patent [19]

Dacyshyn

[11] Patent Number: 6,026,516

[45] Date of Patent: Feb. 22, 2000

[54] SUSPENDERS

[75] Inventor: Gregory Roman Dacyshyn, Waterbury, Vt.

[73] Assignee: The Burton Corporation, Burlington, Vt.

[21] Appl. No.: 09/002,963

[22] Filed: Jan. 5, 1998

[51] Int. Cl.[7] ..... A41D 1/00

[52] U.S. Cl. ..... 2/323; 2/79; 2/69; 2/227

[58] Field of Search ..... 2/323, 326, 327, 2/328, 329, 330, 340, 79, 227, 80, 83, 228, 69

[56] References Cited

U.S. PATENT DOCUMENTS

| | | | |
|---|---|---|---|
| Re. 33,966 | 6/1992 | Robison . | |
| 80,142 | 7/1868 | Cleveland | 2/323 |
| 112,746 | 3/1871 | Smith | 2/323 |
| 360,049 | 3/1887 | Raymond et al. | 2/323 |
| 660,165 | 10/1900 | Ostrom | 2/323 |
| 672,002 | 4/1901 | Katz | 2/323 |
| 678,251 | 7/1901 | Hafer | 2/323 |
| 1,365,056 | 1/1921 | Nabers . | |
| 1,549,672 | 8/1925 | Lazier | 2/323 |
| 1,616,763 | 2/1927 | Siebert . | |
| 2,668,957 | 2/1954 | Schmidt . | |
| 2,732,561 | 1/1956 | Starr | 2/323 |
| 3,484,870 | 12/1969 | Tempelhof . | |
| 3,800,330 | 4/1974 | Bowcut . | |
| 4,481,682 | 11/1984 | Hall . | |
| 4,607,396 | 8/1986 | Craig . | |
| 4,843,647 | 7/1989 | Phillips, Sr. et al. . | |
| 4,887,317 | 12/1989 | Phillips, Sr. et al. . | |
| 4,993,077 | 2/1991 | Robison . | |
| 5,014,356 | 5/1991 | Tomasi-Dubois . | |
| 5,060,315 | 10/1991 | Ewing . | |
| 5,168,582 | 12/1992 | Aldridge . | |
| 5,359,731 | 11/1994 | Cavalier . | |
| 5,497,923 | 3/1996 | Pearson et al. . | |
| 5,611,079 | 3/1997 | Bain, III . | |
| 5,617,581 | 4/1997 | Robbins . | |

FOREIGN PATENT DOCUMENTS

| | | |
|---|---|---|
| 0 059 682 | 9/1982 | European Pat. Off. . |
| 2 686 779 | 8/1993 | France . |
| 1 902 046 | 8/1970 | Germany . |
| 2 140 134 | 2/1973 | Germany . |

OTHER PUBLICATIONS

PCT International Search Report for Application No. PCT/US98/24689.

*Primary Examiner*—Gloria Hale
*Attorney, Agent, or Firm*—Wolf, Greenfield & Sacks, P.C.

[57] ABSTRACT

In one aspect, a pair of suspenders for being detachably secured to a pair of pants, the pants having first and second panels and at least one fastener that detachably secures the first and second panels together. The pair of suspenders includes at least one strap and at least one anchor, attached to the at least one strap, that is adapted to detachably mate with the at least one fastener. In another aspect, the pair of pants has a front panel and a back panel that are detachably secured so that the back panel can be dropped independently of the front panel. The pair of suspenders includes means for attaching the at least one strap to the pair of pants so that the pair of suspenders directly supports the back panel while enabling the back panel to be dropped without removing the suspenders from the shoulders of the wearer. In another aspect, the suspenders are attached to the pair of pants at only two anchors. The suspenders can be employed with a pair of snowpants.

20 Claims, 2 Drawing Sheets

SUSPENDERS

BACKGROUND OF THE INVENTION

1. Field of the Invention

The present invention relates to suspenders, and more particularly, to suspenders for use with snowpants.

2. Background of the Invention

There are two basic types of pants worn by winter sports enthusiasts such as skiers and snowboarders, i.e., overalls and snowpants. Overalls, also known as bibs, typically have a hi-top section that extends above the waist, and permanently attached suspenders. The suspenders are typically secured in the front and back of the bib, with the attachment in at least the back generally being permanent. Some bibs detachably secure the suspenders in the front, typically using a button and metal loop fastener arrangement. Bibs also typically have zippers, either in the front or along the sides, to facilitate the wearer in putting the bibs on and taking them off.

Snowpants typically do not include a hi-top portion extending above the waist. In addition, snowpants do not generally include permanently attached suspenders. Rather, snowpants are generally supported about the wearer's waist in the same manner as other pants, e.g., by employing a pair of pants that fits snugly about the waist or by employing a belt. To enable a single pair to be worn by people with different size waists, some snowpants include an adjustable tightening system along the waistline. One common type of tightening system utilizes a mating set of hook and loop fasteners, known by the trademark Velcro®. This arrangement permits the wearer to adjust the waist of the snowpants to the desired size.

Some snowpants employ a zipper in the front to facilitate entry and exit. Alternatively, other snowpants include a zipper along the side of one or both of the legs for the same purpose. Dual side-zippered snowpants typically include separate front and back panels that are joined at the side zipper seams. Such snowpants have the advantage that the front and back panels can be separated to drop the seat of the pants (e.g., when using bathroom facilities), without removing or lowering the front portion of the pants.

Some snowpants have employed removable suspenders to allow the wearer to optionally use the suspenders only when desired. Typically, such snowpants include some fastening hardware (e.g., a plastic loop) to which the suspenders can be attached. However, the attachment hardware is provided on the snowpants even when the suspenders are not in use. Furthermore, it should be appreciated that when used with snowpants having side zippers, suspenders are conventionally connected to the pants at four locations, i.e., left and right locations on the front panel, and left and right locations on the back panel. When connected in this manner, the advantages of the abovedescribed drop seat feature are diminished because the attachment of the suspenders to the rear panel prevents the seat from being dropped unless the suspenders are first removed from the shoulders of the wearer.

In view of the foregoing, it is an object of the present invention to provide an improved pair of suspenders.

SUMMARY OF THE INVENTION

In one illustrative embodiment of the invention, a pair of suspenders is provided for being detachably secured to a pair of pants, the pants having first and second panels and at least one fastener that detachably secures the first and second panels together. The pair of suspenders comprises at least one strap and at least one anchor, attached to the at least one strap, that is adapted to detachably mate with the at least one fastener.

Another embodiment of the invention is directed to a method of attaching a pair of suspenders to a pair of pants having first and second panels and at least one fastener that can attach the first and second panels together. The method comprises a step of attaching the pair of suspenders to the at least one fastener so that the pair of pants need not include any fastener dedicated exclusively to attaching the pair of suspenders.

A further illustrative embodiment of the invention is directed to a pair of suspenders for a pair of pants, the pair of pants having a front panel and a back panel that are detachably secured so that the back panel can be dropped independently of the front panel. The pair of suspenders comprises at least one strap adapted to be worn over the shoulders of a wearer; and means for attaching the at least one strap to the pair of pants so that the pair of suspenders directly supports the back panel while enabling the back panel to be dropped without removing the suspenders from the shoulders of the wearer.

Another illustrative embodiment of the invention is directed to a combination comprising a pair of pants and a pair of suspenders. The pair of suspenders includes a first strap including front and back components respectively adapted to extend over the front and back of a wearer; a second strap including front and back components respectively adapted to extend over the front and back of the wearer; and a first anchor and a second anchor each attached to both the first and second straps, the first and second anchors being respectively secured to the pants.

A further illustrative embodiment of the invention is directed to a combination, comprising a pair of pants including left and right side fasteners that separate the pair of pants into front and back panels; and a pair of suspenders including at least one strap and a first and second anchors attached to the at least one strap, the first and second anchors being respectively secured to the pants in-line with the right and left side fasteners.

BRIEF DESCRIPTION OF THE DRAWINGS

The foregoing and other objects and advantages will be appreciated more fully from the following drawings, in which.

DETAILED DESCRIPTION OF EMBODIMENTS OF THE PRESENT INVENTION

Figure 1:
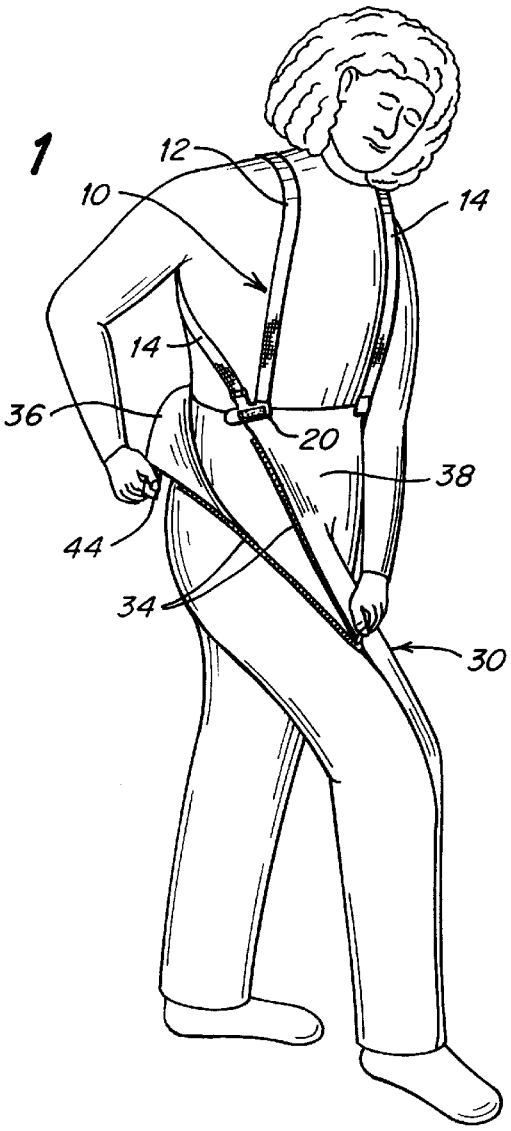
FIG. 1 is a perspective view of a person wearing a pair of side-zipped pants and a pair of suspenders in accordance with one illustrative embodiment of the invention.
Figure 2:
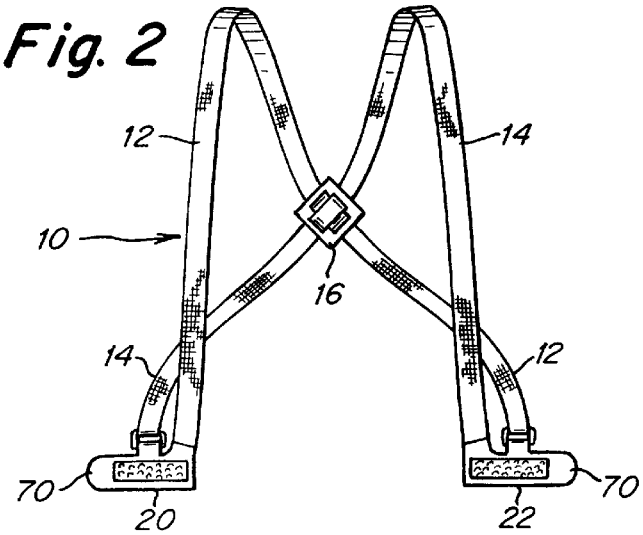
FIG. 2 is a front view of the pair of suspenders illustrated in FIG. 1.

In accordance with the present invention, a pair of suspenders is provided that is attachable to a pair of pants in a novel manner that provides a number of advantages. In one embodiment of the invention, the suspenders have a pair of straps that each includes front and back strap components respectively adapted to fit over the front and back of the wearer's body. In accordance with this embodiment of the invention, the suspenders are attachable to the pants at only two attachment points, rather than the four attachment points employed with conventional suspenders.

In another aspect of the invention adapted for use with a pair of side-zipped pants, a pair of suspenders is provided that enables the back panel of the pants to be dropped without removing the suspenders from the wearer's body. In addition, when the pants are fully zipped, the suspenders are attachable to both the front and rear panels, thereby directly supporting both panels of the pants. As used herein, the reference to "directly" supporting the rear panels is intended to distinguish from a situation wherein a pair of suspenders may be attached only to the front panel, and indirectly support the rear panels only through the direct support of the front panel, and the attachment of the rear panel to the front panel via the side zipper seams.

In a further aspect of the invention, a pair of suspenders is provided that is attachable at the sides of a pair of pants, rather than having front and rear attachment points.

One illustrative embodiment of the present invention is shown in FIGS. 1–4. This embodiment employs each of the aspects of the invention mentioned above. However, it should be appreciated that the invention is not limited in this respect, and that alternate embodiments can employ less than all of the aspects mentioned above.

As discussed above, the present invention is directed primarily to a system for attaching a pair of suspenders to a pair of pants. The attachment system of the present invention can be employed with suspenders of any type. In the illustrative embodiment shown in the figures, the suspenders 10 have a pair of straps 12, 14 and a pair of attachment anchors 20, 22. Strap 12 is arranged to extend from anchor 20, up the front of the wearer's body, over the shoulder, and across the wearer's back, terminating at anchor 22. Conversely, strap 14 is arranged to extend from anchor 22, up the front of the wearer's body, over the opposite shoulder, and across the wearer's back, terminating at anchor 20. The suspenders can optionally include a connector 16 (e.g., in the shape of a diamond) to connect straps 12 and 14 together in the back.

Figure 3:
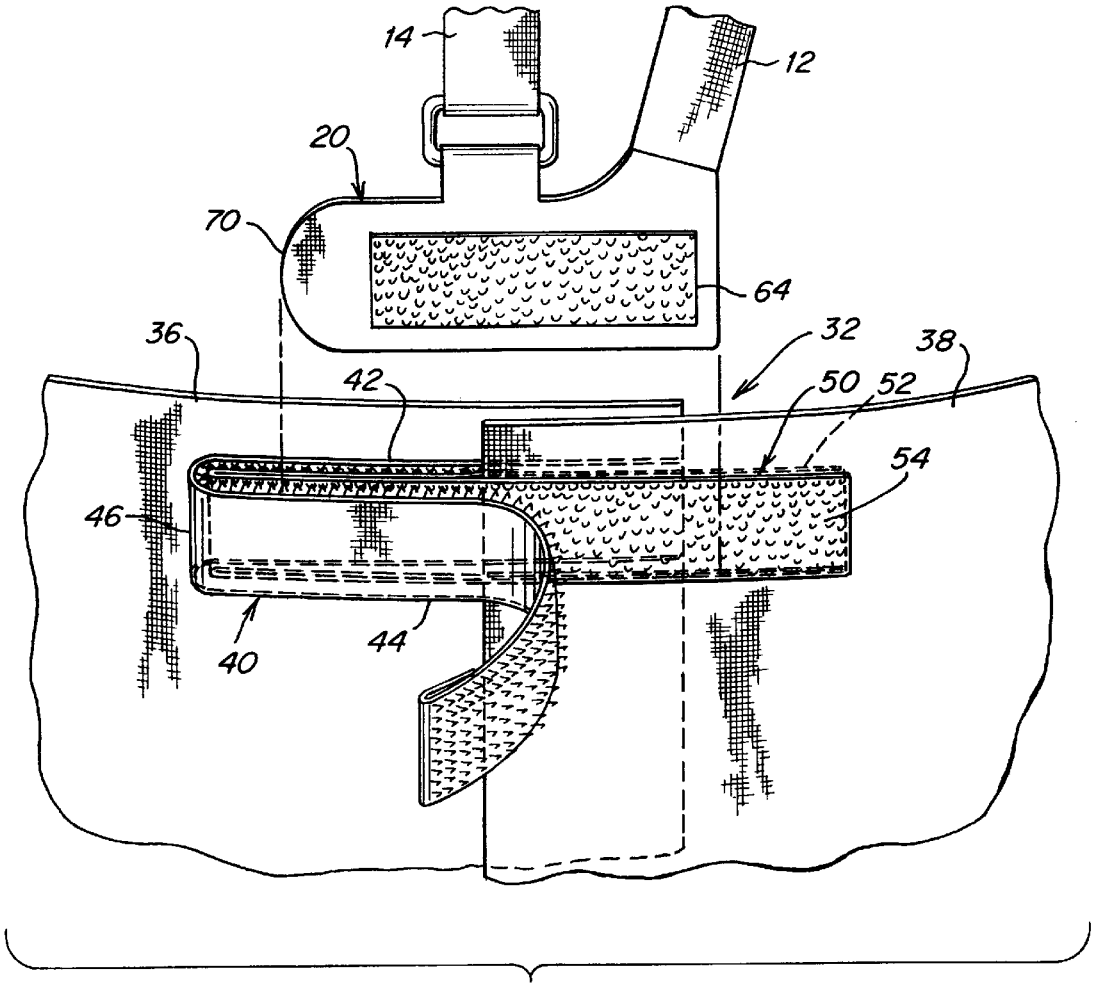
FIG. 3 is a detailed view of the fasteners associated with the suspenders of FIGS. 1–2.

As shown in FIG. 3, the straps 12, 14 extend from the anchors 20, 22 in diverging directions, with one of the straps 12, 14 being a front component adapted to fit over the front of the wearer's body, and the other being a back component to fit over the wearer's back. The use of the anchors 20, 22 enables each pair of front and back strap components to be attachable to a pair of pants at a single attachment point. Thus, in accordance with this embodiment of the invention, the suspenders are attachable to the pants at only two attachment points (e.g., anchors 20, 22) rather than the four attachment points employed with conventional suspenders.

The embodiment of the invention shown in the figures is adapted for use with a pair of pants 30 having the specific structure described below. However, it should be appreciated that the present invention is not limited in this respect, and can be adapted for use with pants having different structures.

The pants illustrated in FIGS. 1–4 are snowboard pants having side waist adjustment features 32 (FIG. 3) known, for example, as surf leash waist adjustment fasteners on pants available from the assignee of the present application, Burton Snowboards of Burlington, Vt. A waist adjustment fastener 32 is provided on each side of the pants, and each employs hook and loop fasteners commonly know by the trademark Velcro®. The snowpants 30 further include a zipper 34 (FIG. 1) on each side, with the waist adjustment fastener 32 disposed above an in-line with the zipper. The pants are divided into a back and front panels 36, 38 that are detachably connected by the zippers 34 and fasteners 32.

The back panel 36 has the hook portion of the fastener 32 attached thereto. The hook portion is formed from a piece of hook tape 40 that is sewn, along part of its length 42, to the back panel 36. A second portion 44 of the hook tape 40 is free to move about a bend 46 to enable the hook tape 40 to engage and disengage with the loop portion of the fastener as discussed below. The front panel 38 of the pants has the loop portion of the fastener attached thereto. In particular, a piece of loop tape 50 is doubled over to form two surfaces of looped material 52, 54, and is sewn to the panel 38. The loop tape 50 and the hook tape 40 are positioned to mate with one another along the waistline of the pant panels 36, 38. When the fastener 32 is engaged, the portion 42 of the hook tape 40 engages with an inner surface 52 of the loop tape 50, and the portion 44 of the hook tape is folded over to engage with an outer portion 54 of the loop tape 50.

As mentioned above, the embodiment of invention shown in the drawings is specifically adapted to be used with pants 30 having the above-described structure. In one aspect of the present invention, the suspenders are attached to the pants 30 using an attachment mechanism that does not require any additional fasteners on the pants, i.e., the suspenders are adapted to be compatible with the fasteners 32 that already exist on the pants. This is advantageous because when the suspenders are removed, the pants do not include any unused fastening features.

When used in conjunction with pants having a hook and loop fastener as discussed above, one embodiment of the present invention employs a compatible fastener to engage with the hook and loop fastener that already exists on the pants. As shown in FIG. 3, the suspenders 10 are attached to the pants 30 via the pair of anchors 20, 22 (only anchor 22 is shown in FIG. 3) that each includes a hook portion 60 (e.g., a piece a hook tape) along one side 62 (FIG. 4), and a loop portion 64 (e.g., a piece of loop tape) on the other side 66. When the suspenders 10 are attached to the pants 30, the anchors 20, 22 are sandwiched between the hook tape 40 of the back panel and the loop tape 50 of the front panel 38. The loop portion 64 of the anchor 20, 22 mates with the hook tape 40 of the back panel 36, while the hook portion 60 of the anchor mates with the loop tape 50 of the front panel 38. In the arrangement shown in FIG. 4, the anchor 22 is positioned between the free portion 44 of the hook tape 40 and the surface 54 of looped material on the outside of the front pant panel 38. However, it should be appreciated that the anchor can alternatively be positioned between the fixed portion 42 of the hook tape 40 and the surface 52 of looped material on the inside of the front pant panel 38.

In the embodiment shown in the figures, the anchors 20, 22 each includes a tab portion 70 that is free of any hook or loop fasteners to facilitate grasping by the wearer. The tab 70 may be on the front of the anchors to facilitate viewing by the wearer. Although advantageous, the tab portions are not necessary.

It should be appreciated that the embodiment of the invention shown in the figures provides a number of advantages. First, by employing the fasteners 32 that already exist on the pants 30 to attach the suspenders, when the suspenders are removed from the pants, no unused attachment features remain on the pants. As discussed above, the present invention is not limited to use with the specific pant fasteners 32 shown in the drawings. Alternate arrangements can be employed to mate with existing pant fasteners of other types.

Figure 4:
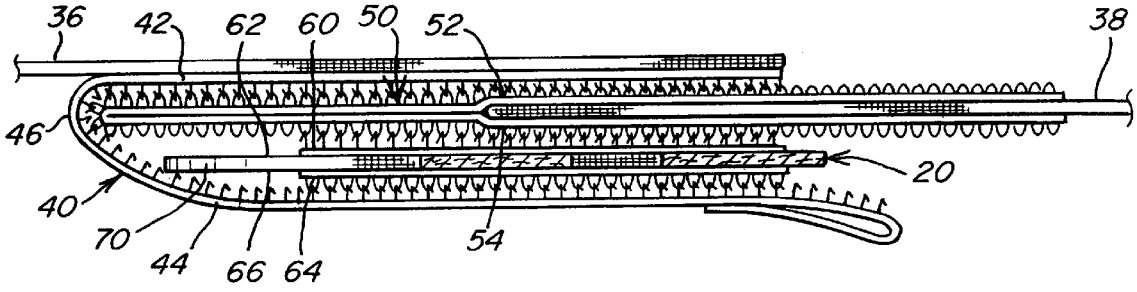
FIG. 4 is a side view of the suspenders of FIGS. 1–3 attached to a pair of pants.

Second, the back panel 36 of the pants can be dropped without removing the suspenders from the wearer's shoulders. For example, when the anchors 20, 22 are disposed between the portion 44 of the free hook tape 40 and the surface 54 of looped material on the outside of the front pant panel 38 as shown in FIG. 4, the back panel can be dropped by: (1) detaching the free portion 44 of the hook tape 40 from the loop portion 64 on the outside of the anchor; (2) detaching the fixed portion 42 of the hook tape 40 from the surface 52 of the looped material of the inside of the front panel 38; and (3) unzipping the side zippers on the pants. In addition, when the suspenders are attached to the pants in the manner shown in FIG. 4, each anchor 20, 22 directly contacts and supports both the front and back panels. Thus, even though the back panel can be dropped, it can also be directly supported by the suspenders. Again, this aspect of the present invention is not limited to use with the specific pant fastener structure shown in the drawings, as other arrangements are possible that will directly support the back panel when the pants are fully fastened, but also allow the back panel to be dropped. For example, although detachably connecting the anchor to both the front and back panels provides the advantages discussed above, in another embodiment of the invention (not shown), the anchor is fixedly attached (e.g., stitched) to the front panel 38. It should be appreciated that in this embodiment, the suspenders are still removably attached to the back panel to allow the pant seat to be dropped, and directly support the back panel when the pants are fully fastened.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. A pair of suspenders for being detachably secured to a pair of pants, the pants having first and second panels and at least one fastener that detachably secures the first and second panels together, the pair of suspenders comprising:

at least one strap;

at least one anchor, attached to the at least one strap, that is adapted to detachably mate with the at least one fastener; and wherein the at least one anchor is adapted to directly support both the first and second panels when mated with the at least one fastener.

2. The pair of suspenders of claim 1, wherein:

the at least one strap includes a first strap and a second strap; and the at least one anchor consists of a first anchor and a second anchor each attached to both the first and second straps, so that the pair of suspenders is securable to the pair of pants at only the first and second anchors.

3. The pair of suspenders of claim 2, wherein:

the first strap includes front and back components respectively adapted to extend over the front and back of a wearer;

the second strap includes front and back components respectively adapted to extend over the front and back of the wearer;

the front component of the first strap and the back component of the second strap each is attached to the first anchor; and the front component of the second strap and the back component of the first strap each is attached to the second anchor.

4. The pair of suspenders of claim 1, wherein the at least one anchor is adapted to directly support both the first and second panels when mated with the at least one fastener.

5. The pair of suspenders of claim 1, in combination with the pair of pants, wherein the first panel is a front panel and wherein the second panel is a back panel, wherein the back panel can be dropped independently of the front panel, and wherein the pair of suspenders directly supports the back panel when the suspenders are secured to the pair of pants.

6. The combination of claim 5, wherein the pair of pants includes first and second side zippers that separate the first and second panels, and wherein the at least one fastener includes first and second fasteners that are respectively disposed above the first and second side zippers.

7. The combination of claim 6, wherein the pair of pants is a pair of snowpants.

8. The pair of suspenders of claim 1, wherein the at least one fastener is a hook and loop fastener, and wherein the at least one anchor includes a hook and loop fastener.

9. A method of attaching a pair of suspenders to a pair of pants having first and second panels and at least one fastener that can attach the first and second panels together, the method comprising a step of:

(A) attaching the pair of suspenders to the at least one fastener so that the pair of pants need not include any fastener dedicated exclusively to attaching the pair of suspenders, and said pair of suspenders directly supports each of said panels.

10. A pair of suspenders for a pair of pants, the pair of pants having a front panel and a back panel that are detachably secured so that the back panel can be dropped independently of the front panel, the pair of suspenders comprising:

at least one strap adapted to be worn over the shoulders of a wearer; and means for attaching the at least one strap to the pair of pants so that the pair of suspenders directly supports the back and front panels while enabling the back panel alone to be dropped without removing the suspenders from the shoulders of the wearer.

11. A combination, comprising:

a pair of pants having at least two panels;

at least two fasteners, each joining at least two of said panels; and a pair of suspenders, the pair of suspenders including;

a first strap including front and back components respectively adapted to extend over the front and back of a wearer;

a second strap including front and back components respectively adapted to extend over the front and back of the wearer; and a first anchor and a second anchor each attached to both the first and second straps, the first and second anchors being respectively secured to the pants at said at least two panels.

12. The combination of claim 11, wherein the pair of pants includes front and back panels, and wherein the pair of suspenders is adapted to directly support both the front and back panels.

13. The combination of claim 12, wherein the pair of suspenders is detachably secured to the back panel.

14. The combination of claim 13, wherein the pair of pants includes left and right side zippers that separate the front and back panels.

15. The combination of claim 13, wherein the pair of pants is a pair of snowpants.

16. The combination of claim 11, wherein the pair of pants includes left and right side zippers that separate the front and back panels.

17. The combination of claim 11, wherein the pair of pants is a pair of snowpants.

18. The combination of claim 16, wherein the first and second anchors are respectively secured to the pair of pants in-line with the left and right side zippers.

19. A combination, comprising:

a pair of pants including left and right side fasteners that separate the pair of pants into front and back panels; and a pair of suspenders including at least one strap and a first and second anchors attached to the at least one strap, the first and second anchors being respectively secured to the pants in-line with the right and left side fasteners.

20. The combination of claim 19, wherein the pair of pants is a pair of snowpants.

* * * * *